US006113222A

United States Patent [19]

Ohkuma

[11] Patent Number: 6,113,222

[45] Date of Patent: Sep. 5, 2000

[54] INK JET RECORDING HEAD AND A METHOD FOR MANUFACTURING SUCH INK JET RECORDING HEAD

[75] Inventor: Norio Ohkuma, Machida, Japan

[73] Assignee: Canon Kabushiki Kaisha, Tokyo, Japan

[21] Appl. No.: 09/146,338

[22] Filed: Sep. 2, 1998

[30] Foreign Application Priority Data

Sep. 4, 1997 [JP] Japan ..... 9-239526

[51] Int. Cl.[7] ..... B41J 2/05

[52] U.S. Cl. ..... 347/63; 347/67

[58] Field of Search ..... 347/63, 65, 67; 216/27

[56] References Cited

U.S. PATENT DOCUMENTS 4,789,425 12/1988 Drake et al. ..... 156/644

5,786,832 7/1998 Yamanaka et al. ..... 347/45

FOREIGN PATENT DOCUMENTS 0 609 911 8/1994 European Pat. Off. .

*Primary Examiner*—John Barlow

*Assistant Examiner*—J. Stephens

*Attorney, Agent, or Firm*—Fitzpatrick, Cella, Harper & Scinto

[57] ABSTRACT

An ink jet recording head is provided at least with ink discharge pressure generating elements, nozzles for discharging ink liquid droplets, and a through opening formed by means of Si anisotropic etching for the ink supply on the Si substrate having <100 > plane orientation. Then, the oxygen concentration of the Si substrate having the <100> plane orientation is arranged to be 1.3E18 (atoms/cm$^3$) or less. With the substrate thus arranged, it becomes possible to enhance the production yield when forming the ink supply ports by means of the Si anisotropic etching, and at the same time, it is possible to reduce the variation of the widths of the ink supply ports that may be caused by the Si anisotropic etching. Thus, the ink discharge frequency is enhanced.

2 Claims, 2 Drawing Sheets

INK JET RECORDING HEAD AND A METHOD FOR MANUFACTURING SUCH INK JET RECORDING HEAD

BACKGROUND OF THE INVENTION

1. Field of the Invention

The present invention relates to an ink jet recording head that creates ink liquid droplets used for ink jet recording. More particularly, the invention relates to an ink jet recording head obtainable by a method for stably forming an ink-supply through opening by means of Si anisotropic etching. The invention also relates to a method for manufacturing such head.

2. Related Background Art

Conventionally, it has been generally practiced to provide the ink-supply through opening for the substrate of an ink jet (hereinafter referred to as IJ) head of the so-called side shooter type where ink liquid droplets are discharged in the direction perpendicular to the surface of the substrate on which the ink discharge pressure generating elements are formed.

As a method of the kind, there are known the mechanical method for processing substrates by means of sand blasting, and the Si chemical etching method for processing them.

Particularly, the Si anisotropic etching is most preferably applicable to the method for forming the ink-supply through opening, because with this type of etching, the through opening can be formed in good precision.

With the ink supply port precisely formed, it becomes possible to shorten the distance between the ink supply port and the ink discharge pressure generating elements. As a result, the ink discharge frequency is significantly enhanced (see the specifications of U.S. Pat. No. 4,789,425, and EP 0609911A2).

However, when the through opening is formed by means of the anisotropic etching, abnormal etching may take place in some cases due to the defective Si crystals (such abnormal etching leads to the resultant variation of the widths of through openings thus formed to a considerable extent, because the planes other than the <100> plane are also etched with each defective crystal as its starting point). This is one of the factors that may cause the reduction of the production yield.

Further, when the Si anisotropic etching is performed, the starting time of etching may minutely vary depending on the state of the surface where the etching begins, as well as on the etching conditions (such as the concentration of etching solution, temperature, among some others). Therefore, there is a need for an overetching in order to complete the penetration for the formation of each ink supply port reliably.

However, with the overetching, there occurs the side etching on the Si wafer in the horizontal direction. As a result, the resultant width of each through opening varies minutely, leading to the drawback that the distance may vary between the ink supply port and the ink discharge pressure generating elements.

SUMMARY OF THE INVENTION

The present invention is designed in consideration of the problems described above. It is an object of the invention to provide a method whereby to easily attain the formation of the ink supply port of the side shooter type IJ head in good precision, and the enhanced ink discharge frequency as well, by means of the Si anisotropic etching capable of improving the yield of the ink supply port formation by making the variation of the widths of ink supply ports smaller.

The object described above can be achieved by the present invention given below. In other words, the ink jet recording head of the present invention is provided at least with an ink discharge pressure generating element, a nozzle for discharging an ink liquid droplet, and a through opening formed by means of Si anisotropic etching for the ink supply on the Si substrate having <100> plane orientation. Then, the oxygen concentration of the Si substrate having the <100> plane orientation is arranged to be 1.3E18 (atoms/$cm^3$) or less.

Also, the method of the present invention for manufacturing an ink jet recording head comprises the steps of preparing Si substrate having <100> plane orientation and an ink discharge pressure generating element; forming a nozzle for discharging an ink liquid droplet; and forming a supply port on the substrate by means of anisotropic etching for supplying ink to the nozzle. Then, the oxygen concentration of the Si substrate having the <100> plane orientation is arranged to be 1.3E18 (atoms/$cm^3$) or less.

DETAILED DESCRIPTION OF THE PREFERRED EMBODIMENTS

Hereinafter, the specific description will be made of the embodiments of the present invention.

Figure 1:
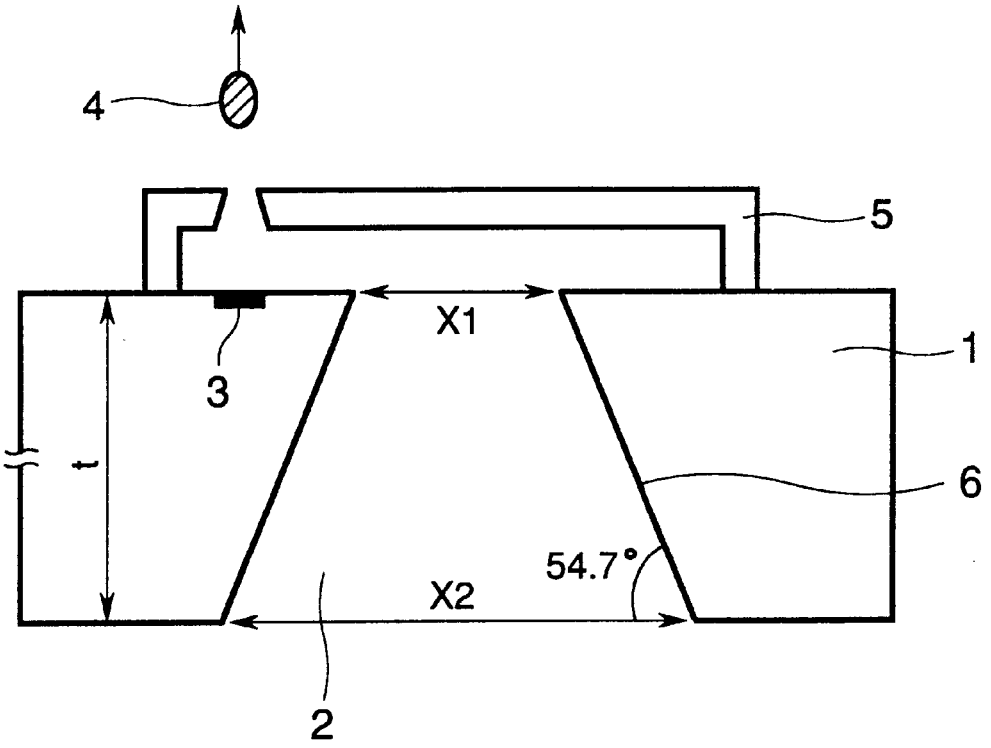
FIG. 1 is a cross-sectional view which schematically shows the basic embodiment of the present invention (that is, an IJ head whose ink supply port is formed by the Si anisotropic etching).

With reference to the accompanying drawings, the present invention will be described in detail. FIG. 1 is a cross-sectional view which shows the IJ head whose ink supply port is formed by means of the Si anisotropic etching. By use of an Si substrate having the <100> plane orientation, the ink-supply through opening 2 is formed by means of the anisotropic etching for the supply of ink, and then, the ink liquid droplet 4 is discharged through the nozzle 5 in the direction indicated by an arrow by use of the ink discharge pressure generating element 3.

In this respect, the nozzles 5 are arranged each deviated at half pitches on both sides of the ink supply port that resides between them.

Here, for the anisotropic etching of the Si substrate which is provided with the <100> plane orientation, the ink supply port wall surfaces 6 (plane orientation <111>) are formed at an angle of 54.7° to the <100> plane (that is, the reverse side of the substrate). Therefore, given the opening on the reverse side of the anisotropic etching as a distance X2, the opening on the surface side of the substrate X1 is regulated by the following universal formula:

$$X1=X2-2t/\tan 54.7^\circ \quad (t=\text{the wafer thickness})$$

Figure 2:
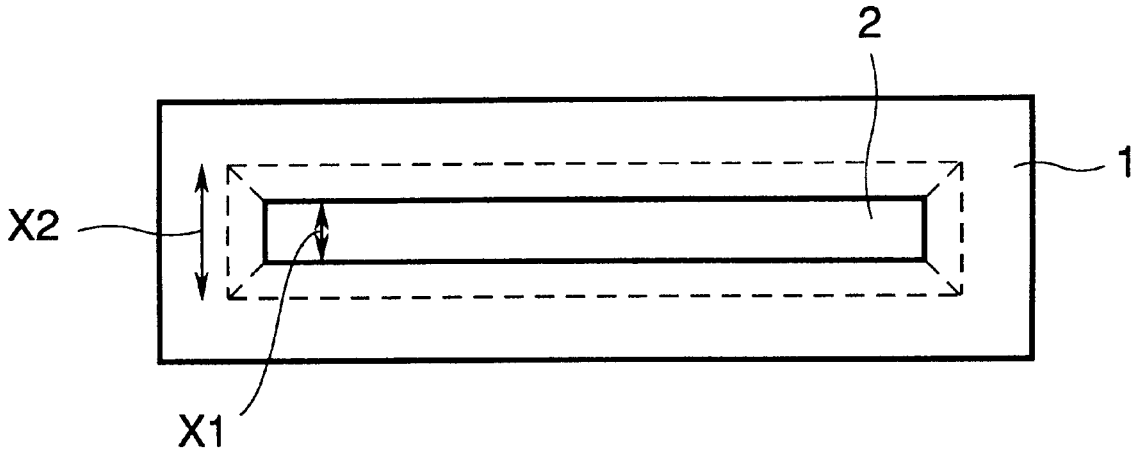
FIG. 2 is a plan view which schematically shows the basic embodiment of the present invention (that is, the plan view showing the head without the nozzle portion).

Assuming that there are no defective crystals on the Si substrate, the through opening is formed with its width X1 as shown in FIG. 2 (which is the plan view of the head but not showing any nozzle portion), making it possible to regulate the distance between the opening and the ink discharge pressure generating elements exactly.

Figure 3:
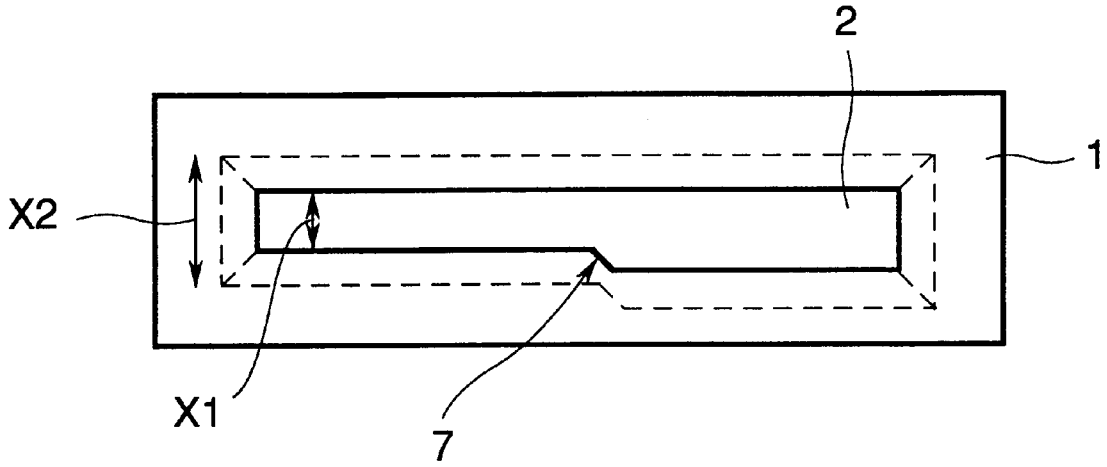
FIG. 3 is a plan view which schematically shows the basic embodiment of the present invention (as to the abnormal etching).

However, if any defective crystals are present on the Si substrate, the through opening may be locally deviated greatly from the designed width as shown in FIG. 3 (abnormal etching at 7 in FIG. 3). This becomes one of the factors that may cause the considerable reduction of the production yield.

The defective crystals of the Si substrate may be brought about by various factors, but the inventors hereof have found after diligent studies that the formation of the <111> plane using the anisotropic etching is greatly affected by the oxygen concentration of the Si substrate. On the basis of this finding, the present invention has been designed and completed.

In other words, it has been found that the occurrence of such abnormal etching as has been described above is suddenly reduced if the oxygen concentration of the Si substrate used is arranged to be 1.4E18 (atoms/$cm^3$) or less.

Further, the inventors hereof have found that when the oxygen concentration of the Si substrate is 1.3E18 (atoms/$cm^3$) or less, the side etching becomes extremely small even with the execution of the overetching.

Figure 4:
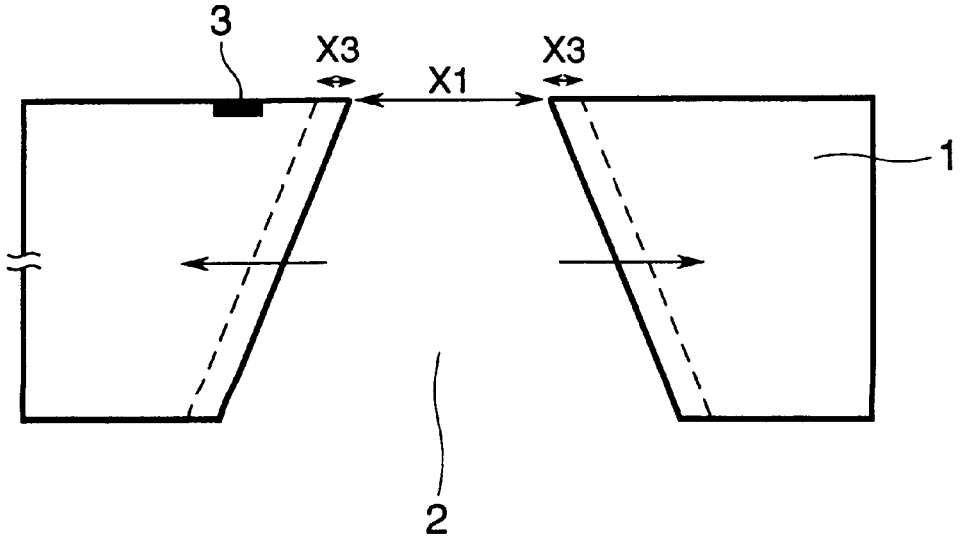
FIG. 4 is a cross-sectional view which schematically shows the basic embodiment of the present invention (as to the case where each side etching X3 is created in the direction indicated by an arrow when the overetching is performed after the penetration of the ink supply port, but the side etching becomes extremely small by use of the substrate).

In other words, as shown in FIG. 4, the side etching X3 is created each in the direction indicated by an arrow when the overetching is performed after the complete penetration of the ink supply port, but by the use of the substrate described above, it is possible to make such side etching extremely small.

As described earlier, for the execution of the Si anisotropic etching is performed, it is a prerequisite that an overetching is given in order to complete the penetration of an ink supply port exactly, because the etching start time may vary minutely due to the state of the surface where the etching begins and also, due to the etching conditions (the concentration of the etching solution, temperature, and the like).

Here, the ultimate width of the ink supply port formed is X1+2×3. Therefore, if the value of the X3 is made smaller, it becomes possible to make the resultant distance shorter between the ink supply port and the ink discharge pressure generating elements. In this way, the ink discharge frequency can be enhanced.

[Embodiments]

Now, hereunder, the detailed description will be made of the embodiments in accordance with the accompanying drawings. In this respect, however, it is to be understood that the present invention is not necessarily limited to the embodiments to be described herein. It should be good enough if only the embodiments are made capable of achieving the objectives of the present invention.

[Embodiment 1]

In accordance with the present embodiment, an IJ head is produced with the structure as shown in FIG. 1. At first, ink discharge pressure generating elements 3, nozzles 5, and chips having ink supply ports 2 prepared by means of the anisotropic etching are formed appropriately on a 5-inch Si substrate 1 (625 μm thick) which is provided with the oxygen concentration of 1.2E18 to 1.3E18 (atoms/$cm^3$), and with the plane orientation <100> as well. Here, 250 chips are etched on the 5-inch substrate.

In this respect, the anisotropic etching of the ink supply port uses 22 wt % water solution of TMAH (tetramethyl ammonium hydroxide) as its etching solution at a temperature of 80° C. with silicon nitride ($Si_3N_4$) as its mask.

The Si etching rate in the aforesaid condition is 0.50 μm/min. Then, in order to penetrate the substrate of 625 μm thick, it takes 20.8 hours. However, for the reasons described above, the etching is performed for a period of 24 hours (that is, a 15% overetching is executed).

After the completion of the anisotropic etching, the abnormal etching caused by the defective crystals is examined and counted, with the result being shown in Table 1. In addition, as the comparison example, there is shown the result of the anisotropic etching performed by use of the substrate whose oxygen concentration is 1.45E18 to 1.47E18 (atoms/$cm^3$).

TABLE 1

| | Substrate Nos. | Oxygen concentration (atoms/$cm^2$) | Counts of abnormal etching | Defect ratio |
|---|---|---|---|---|
| Embodiment | 1 | 1.27E + 18 | 3 | 1.20% |
| | 2 | 1.28E + 18 | 5 | 2.00% |
| | 3 | 1.25E + 18 | 2 | 0.80% |
| | 4 | 1.30E + 18 | 2 | 0.80% |
| | 5 | 1.15E + 18 | 3 | 1.20% |
| Comparison example | 6 | 1.45E + 18 | 28 | 11.20% |
| | 7 | 1.47E + 18 | 25 | 10.00% |
| | 8 | 1.45E + 18 | 30 | 12.00% |

As clear from the Table 1, when the oxygen concentration is 1.3E18 or less (Substrate Nos. 1 to 5), the defect ratios become significantly smaller.

Now, the width of ink supply port is measured for each of the substrates. The results are shown on the Table 2.

TABLE 2

| | Substrate Nos. | Mean value of the widths of ink supply ports (n = 15) [μm] | σ [μm] |
|---|---|---|---|
| Embodiment | 1 | 155 | 3 |
| | 2 | 158 | 4 |
| | 3 | 162 | 6 |
| | 4 | 149 | 5 |
| | 5 | 157 | 3 |
| Comparison example | 6 | 166 | 3 |
| | 7 | 180 | 15 |
| | 8 | 167 | 22 |

As clear from the Table 2, when the substrates whose oxygen concentration is 1.4E18 or less are used, the variation of the widths of the ink supply ports thus formed is extremely small.

Further, as to the substrate Nos. 1 and 6, the amount of the side etching after the penetration is measured, respectively, with attention given to specific chips, the result is: 2 to 3 μm/Hr for the substrate No. 1, while 19 μm/Hr.

In other words, it is understandable that the difference in the amount of side etching is the controlling factor as to the variation of the widths of the supply ports.

In accordance with the present invention, it is possible to enhance the production yield when forming the ink supply ports by means of the Si anisotropic etching. Also, it is possible to reduce the variation of the width of the ink supply ports resulting from the Si anisotropic etching, hence enhancing the ink discharge frequency.

What is claimed is:

1. An ink jet recording head provided at least with an ink discharge pressure generating element, a nozzle for discharging an ink liquid droplet, and a through opening formed by means of Si anisotropic etching for the ink supply on the Si substrate having <100> plane orientation, the oxygen concentration of Si substrate having said <100> plane orientation being 1.3E18 (atoms/$cm^3$) or less.

2. A method for manufacturing an ink jet recording head comprising the following steps of:

preparing an Si substrate having <100> plane orientation and an ink discharge pressure generating element;

forming a nozzle for discharging an ink liquid droplet; and forming a supply port on said substrate by means of anisotropic etching for supplying ink to said nozzle, the oxygen concentration of Si substrate having said <100> plane orientation being 1.3E18 (atoms/$cm^3$) or less.

* * * * *

UNITED STATES PATENT AND TRADEMARK OFFICE

CERTIFICATE OF CORRECTION

PATENT NO. : 6,113,222

DATED : September 5, 2000

INVENTOR(S) : NORIO OHKUMA

It is certified that error appears in the above-identified patent and that said Letters Patent is hereby corrected as shown below:

COLUMN 5

Line 5, "the" should read --an--;
Line 6, "the" should read --a--; and
Line 7, "of" should read --of the--.

COLUMN 6

Line 1, "an" should read --a--;
Line 4, "said" should read --said Si--; and
Line 6, "of" should read --of the--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*